United States Patent [19]

Reid

[11] 4,041,677

[45] Aug. 16, 1977

[54] PACKAGING APPARATUS

[75] Inventor: Laurie M. Reid, Luthersville, Ga.

[73] Assignee: Anderson Bros. Mfg. Co., Rockford, Ill.

[21] Appl. No.: 619,897

[22] Filed: Oct. 6, 1975

[51] Int. Cl.[2] ..... B65B 11/08; B65B 35/30

[52] U.S. Cl. ..... 53/159; 53/182 R; 198/425; 198/480

[58] Field of Search ..... 53/48, 159, 180 R, 182 R, 53/184 S; 198/34, 425, 459, 476, 480

[56] References Cited

U.S. PATENT DOCUMENTS

| | | | |
|---|---|---|---|
| 3,194,382 | 7/1965 | Nigrelli et al. | 53/159 X |
| 3,340,996 | 9/1967 | Cerf | 53/180 X |
| 3,447,280 | 6/1969 | Cunningham et al. | 53/48 |
| 3,513,629 | 5/1970 | Hoagland et al. | 53/182 |
| 3,760,553 | 9/1973 | Schmidt et al. | 53/182 X |
| 3,807,128 | 4/1974 | Bauer | 53/159 |
| 3,830,036 | 8/1974 | Harkness et al. | 53/182 X |
| 3,869,846 | 3/1975 | Timmerbeil | 53/182 |
| 3,902,301 | 9/1975 | Harkness et al. | 53/182 X |

*Primary Examiner*—Robert Louis Spruill
*Attorney, Agent, or Firm*—Morsbach & Pillote

[57] ABSTRACT

Sleeve wrapping apparatus, particularly for wrapping units each consisting of a plurality of products, such as cans, of relatively low stability, which enables orderly wrapping of a unit without the use of a tray or other receptacle for holding the products in the unit against disorientation, comprising a conveyor for conveying units to be wrapped through a sealing station, means for supplying webs of heat-sealable wrapping material to lie under and over a unit, means for sealing the webs together at the sealing station, and means for separating a number of rows of product from an infeed of products to constitute units each comprising said number of rows for delivery to said conveyor.

2 Claims, 13 Drawing Figures

PACKAGING APPARATUS

BACKGROUND OF THE INVENTION

This invention relates to packaging apparatus, and more particularly to so-called sleeve wrapping apparatus for sleeve wrapping products in heat-shrinkable film for subsequent shrinking in a shrink tunnel.

The invention is especially concerned with apparatus of a type heretofore sold by the assignee of this application known as a "sleeve wrapper" in which a unit to be wrapped is fed forward by a conveyor against a vertical reach of film comprising a first web issuing from an upper roll and extending downwardly and a second web issuing from a lower roll and extending upwardly with the ends of the two webs heat-sealed together. As the unit moves forward, the upper web is draped over the unit and the lower web is draped under it. The unit then dwells in place while a pair of seal bars are closed behind the unit to heat-seal the two webs together on the trailing side of the unit and to sever the webs through the seal so as to provide a trailing seal for the film draped around the unit to form a sleeve, and a seal constituting the leading seal for the next sealing operation. After the sealing operation, the bars are opened and the enwrapped unit is fed forward away from the webs and another unit fed forward for being wrapped.

Reference may be made to my coassigned copending application Ser. No. 435,731, filed Jan. 23, 1974, now U.S. Pat. No. 3,927,507, showing a development in sleeve wrappers involving the provision of a drive for the conveyor of the wrapper adapted to effect smooth starting and stopping of the conveyor so as to enable handling of units of relatively low stability (e.g., filled bags) without the units tipping over or becoming disoriented while wrapping the units at commercially necessary speeds (e.g., up to 30–40 cycles per minute). While the sleeve wrapper shown in said application Ser. No. 435,731 is quite satisfactory for wrapping single items (which may be of low stability, such as a filled bag standing upright), it is not always satisfactory for wrapping a unit which comprises a plurality of products each of which may be of low stability, such as a plurality of cans (e.g., two dozen loose cans standing upright arranged in a four-by-six array, or four six-packs of cans arranged in a two-by-two array) unless the products making up the unit are packaged in a tray before being wrapped and then wrapped with the tray. This problem is encountered not only with loose cans, for example, but also with six-packs of cans in which the six cans are held together by an apertured sheet plastic carrier of the type known as the HICONE carrier (for which reference may be made to U.S. Pat. No. 2,874,835). Even with such a carrier, in wrapping six-packs with the sleeve wrapper of the aforesaid application Ser. No. 435,731, the cans may angle outwardly away from one another or the packs may become separated, unless confined by a tray.

SUMMARY OF THE INVENTION

Accordingly, among the several objects of this invention may be noted the provision of an improved sleeve wrapper which is adapted efficiently and reliably to wrap units each consisting of a plurality of products, such as cans or filled bags, of relatively low stability without disorientation of the products, so that a unit may be sleeve-wrapped with the individual items of the unit retained in their proper array without the use of a tray or case for the unit, or the use of any packaging material other than the sleeve-wrapping material (and a plastic carrier or the like where such is used); the provision of such a sleeve wrapper wherein the individual items of a unit are maintained together in order, as they are fed forward for being sleeve-wrapped, even though they may be unstable; and the provision of such a sleeve wrapper which is adapted to handle a wide variety of products.

In general, sleeve-wrapping apparatus of this invention comprises an endless conveyor having a generally horizontal upper reach for transporting units to be sleeve-wrapped (e.g., two dozen loose cans or four six-packs of cans) forward along a generally horizontal path, with a return reach below the upper reach. The conveyor is of special construction, comprising a series of supports each adapted to hold a unit to be wrapped with the supports spaced at equal intervals along and throughout the length of the conveyor with gaps between the supports, the gaps being spaced at the same intervals. Means is provided for intermittently indexing the conveyor forward through a distance equal to one of the stated intervals with a dwell between successive cycles of operation so as successively to bring a gap in the conveyor to a sealing station located along the stated path. Thus, during each dwell of the conveyor between cycles, there is a gap at the sealing station, a support at a first position immediately upstream from the sealing station and a support at a second position immediately downstream from the sealing station. The support at the first position is adapted to hold a unit (e.g., two dozen loose cans or four six-packs) to be wrapped (without a tray) and to transport it, on indexing of the conveyor, through the sealing station to the second position. Means is provided for supplying a first web of heat-sealable wrapping material to lie under a unit and for supplying a second web of such material to lie on top of a unit as the unit proceeds to the second station, the ends of the two webs being heat-sealed together. Means is provided for sealing the two webs together at the sealing station and severing the webs through the seal to form a trailing seal for the webs draped around the unit at the second position and a leading seal for the unit at the first position, this sealing means being operable through the gap in the endless conveyor at the sealing station during each dwell of the conveyor.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1A:
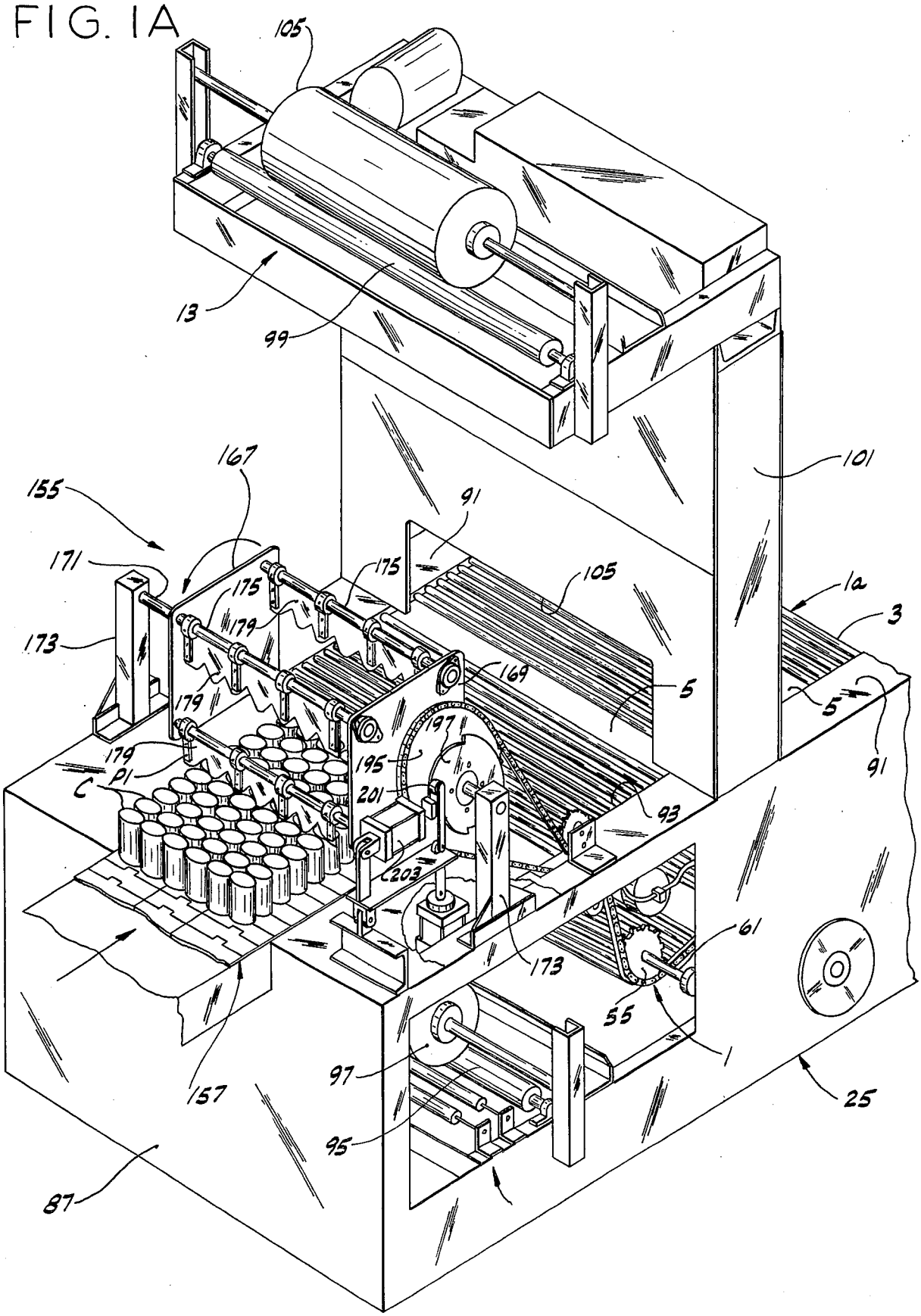
FIG. 1A is a perspective of part of a packaging apparatus incorporating the invention, showing a sleeve-wrapping section of the apparatus.
Figure 1B:
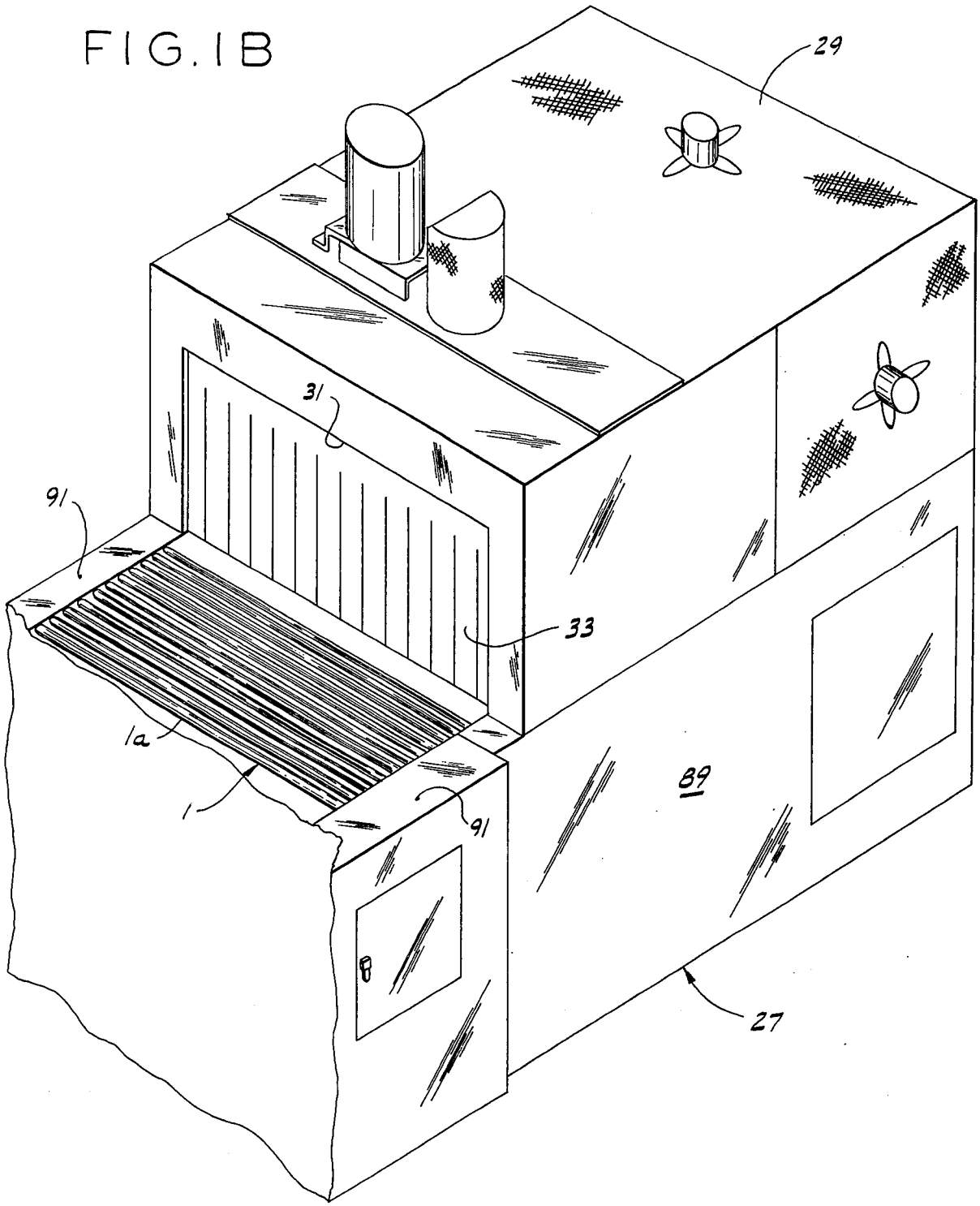
FIG. 1B is a perspective in continuation of FIG. 1A showing a shrink tunnel section of the apparatus.

Referring to the drawings, first more particularly to FIGS. 1A, 1B and 2, sleeve-wrapping apparatus of this invention is shown to comprise an endless conveyor designated in its entirety by the reference numeral 1 having a generally horizontal upper reach 1*a* for transporting units U (see FIGS. 3 and 9–12) to be sleeve-wrapped forward along a generally horizontal path, and a return reach 1*b* (see FIG. 2) below the upper reach 1*a*. The conveyor comprises a series of supports 3 each adapted to hold a unit U to be wrapped spaced at equal intervals I along and throughout the length of the conveyor, with gaps 5 between the supports 3 spaced at intervals I (see FIG. 9). As illustrated in FIGS. 9–12, unit U consists of 24 cans (e.g., cans of a soft drink), each can being designated C. The 24 cans are upright, arranged in four transverse rows T1 – T4 of six cans each (or six longitudinal rows L1 – L6 of four cans each).

Figures 2, 3:
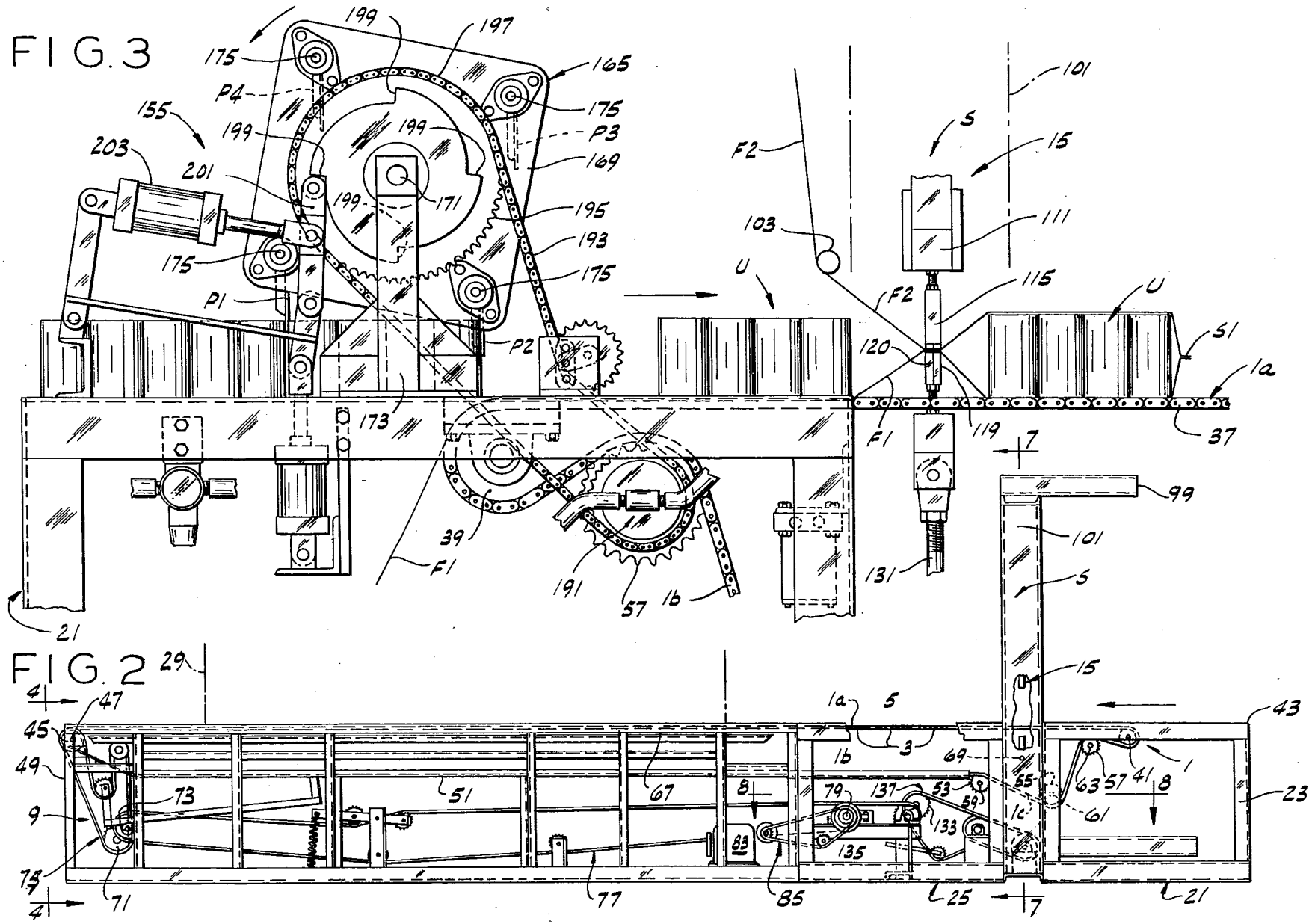
FIG. 2 is a side elevation of the apparatus with parts removed.
FIG. 3 is an enlarged fragmentary side elevation of the opposite side of the apparatus from FIG. 2, showing certain sealing means closed on the webs and showing one end of a reel of a delivery means.

At 9 (see FIG. 2 is generally indicated means for intermittently indexing the conveyor 1 forward (i.e., index its upper reach 1*a* from right to left as viewed in FIG. 2 and left to right as viewed in FIGS. 3 and 9–12) through a distance equal to one of the intervals I with a dwell between successive cycles of operation successively to bring a gap 5 in the upper reach of the conveyor to a sealing station S located along the path of travel of the upper reach of the conveyor whereby, during each dwell of the conveyor between cycles, there is a gap 5 at the sealing station S, a support specially designated 3*a* at a first position immediately upstream from the sealing station, and a support specially designated 3*b* at a second position immediately downstream from the sealing station. The support 3*a* at the first position is adapted to hold a unit U (consisting, for example, of four transverse rows T1 – T4 of six cans each) to be wrapped and to transport this unit, on indexing of the conveyor, through the sealing station S to the second position (at 3*b*).

At 11 (see FIG. 1A) is generally indicated means for supplying a first web F1 of heat-sealable, heat-shrinkable wrapping material (e.g., polyethylene film) to lie under a unit U as it proceeds to the second position at 3*b*, and at 13 is generally indicated means for supplying a second web F2 of the same material to lie on top of the unit U as it proceeds to the second position 3*b*. The ends of the two webs are heat-sealed together as indicated at S1. At 15 (see FIGS. 2, 3, 7 and 9–11) is generally indicated means for sealing the two webs together at the sealing station S and severing the webs through the seal to form a trailing seal S2 for the webs draped around the unit at the second position and a leading seal, i.e., the seal S1, for the unit at the first position (see FIGS. 3, 9 and 10). The sealing means is operable through the gap 5 in the upper reach 1*a* of the endless conveyor 1 at the sealing station S during each dwell of the conveyor.

Figure 4:
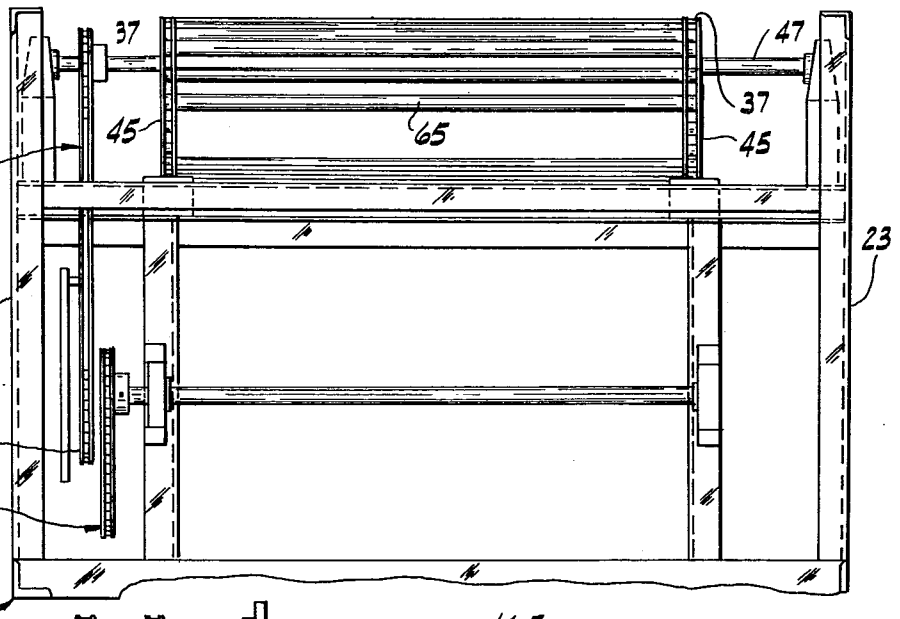
FIG. 4 is an end elevation of FIG. 2 on line 4—4 of FIG. 2.
Figure 6:
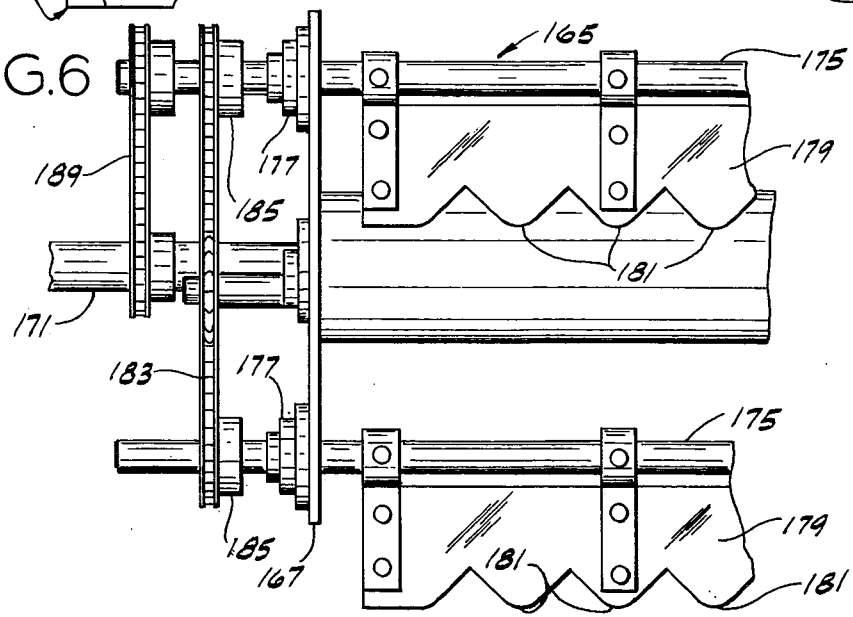
FIG. 6 is a fragmentary view on line 6—6 of FIG. 5.
Figure 5:
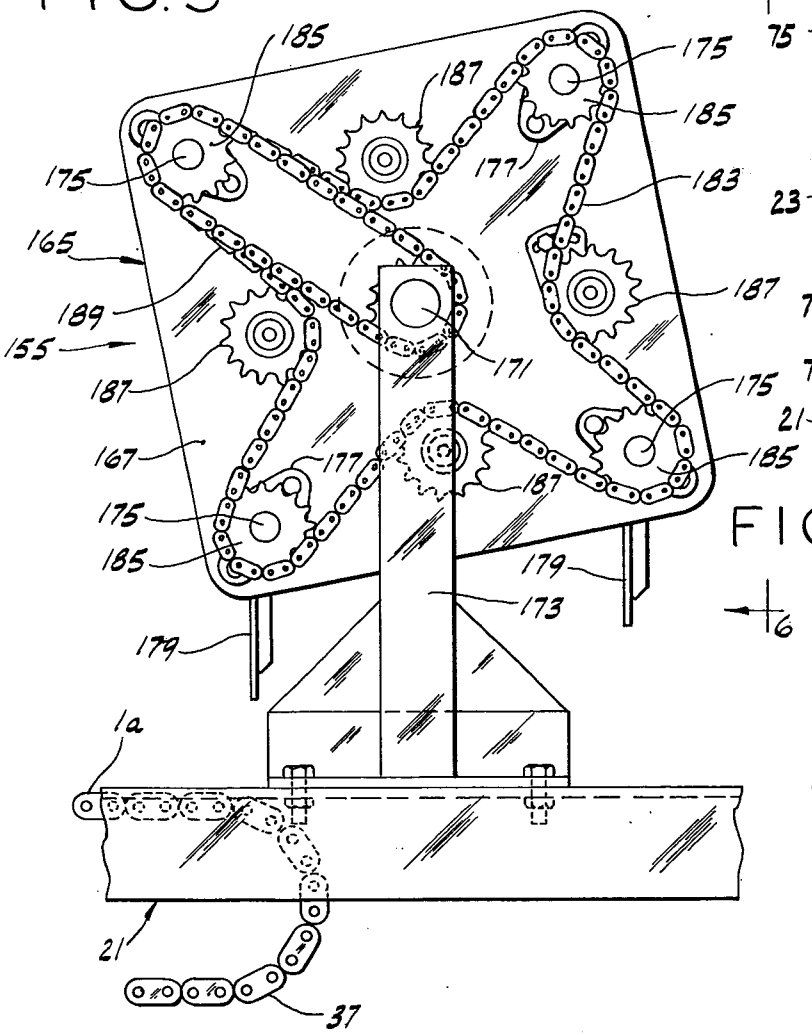
FIG. 5 is a view of the other end of the reel.

More particularly, the sleeve-wrapping apparatus of this invention comprises an elongate base frame designated in its entirety by the reference numeral 21 (see FIGS. 2 and 4). The opposite sides of this frame are each designated 23. The frame has what may be referred to as a wrapping section 25 and a shrink tunnel section 27, the latter including a shrink tunnel 29 overlying the frame having an entrance 31 with the usual curtain 33 and an exit at 35, which may also be equipped with a curtain (not shown). The endless conveyor 1 comprises a pair of side chains each designated 37 trained around a system of sprockets including a pair of sprockets 39 on a horizontal shaft 41 mounted in the frame somewhat downstream from what may be termed the entrance end 43 of the frame, and a pair of sprockets 45 on a horizonatal shaft 47 mounted in the frame adjacent what may be termed its exit end 49. The upper reach 1*a* of the conveyor travels forward in a horizontal path along the top of the frame between the sprockets 39 and the sprockets 45 and the return reach 1*b* of the conveyor travels back from sprocket 45 to sprockets 39 via a pair of tracks 51 at opposite sides of the frame and pairs of sprockets 53, 55 and 57 on shafts 59, 61 and 63 mounted on the frame.

Each of the supports 3 of the endless conveyor 1 is constituted by a set of rollers 65 extending between the side chains 37 of the conveyor. Each set may include twelve such rollers, for example, spaced longitudinally of the conveyor a distance less than the diameter of a can such that each can is adapted to rest on two adjacent rollers. In an embodiment of the apparatus particularly for wrapping beverage cans of 2 $\frac{5}{8}$ inch diameter, each of the 12 rollers 65 may be of 7/16 inch diameter and the rollers may be spaced at 1 $\frac{1}{4}$ inches intervals for full support of each can. Each gap 5 may measure 3$\frac{1}{2}$ inches longitudinally of the conveyor. The chains 37 are preferably roller chains, and the sides of the frame have upper tracks at 67 extending horizontally at the top thereof on which the rollers of the chain ride, thus providing low-friction support for the upper reach 1*a* of the conveyor. The tracks 51 for the return reach 1*b* of the conveyor extend generally horizontally at the sides of the frame below the upper tracks 67 from adjacent the exit end 49 of the apparatus to adjacent the sealing station S to guide the return reach 1*b* of the conveyor to travel generally horizontally back from the exit end to adjacent the sealing station, and sprockets 53, 55 and 57 then guide the return reach down below the sealing station and then up to the upstream end of the upper reach (at sprockets 39) to provide a space indicated at 69 in FIGS. 2 and 7 between the upper and lower reach at the sealing station for accommodating certain components of the sealing means as will appear.

The means 9 for intermittently indexing the conveyor 1 forward through a distance equal to the interval I is shown to comprise a chain and sprocket drive mechanism corresponding to the chain and sprocket drive mechanism shown in my aforesaid U.S. application Ser. No. 435,731 including a sprocket 71 (corresponding to sprocket 15 of said application) fixed to a sprocket 73 (corresponding to sprocket 11 of said application), with a chain drive 75 from sprocket 15 to the shaft 47 (see FIG. 2). Sprocket 73 is driven via a chain and sprocket drive 77 from a drive shaft 79, the latter being driven from a motor 81 via a speed changer 83 and a chain and sprocket drive 85. As will be understood from my aforesaid application, sprocket 71, continuously rotating around the axis of sprocket 73 without rotating around its own axis, generates an intermittent motion of the conveyor 1 (with smooth start and stop), and is adapted intermittently to index the upper reach 1*a* of conveyor 1 forward through a distance I with a dwell between successive cycles of operation successively to bring a gap 5 in the upper reach of the conveyor to the sealing station S.

A cabinet structure 87 (FIG. 1A) encloses the frame 21 in the wrapping section 25, and a cabinet structure 89 (FIG. 1B) encloses the frame in the shrink tunnel section 27. Each cabinet structure has a pair of top panels 91 at opposite sides thereof with a relatively wide space as indicated at 93 in FIG. 1A between these panels. The upper reach 1*a* of the conveyor 1 travels directly below this space 93 so that units U may be carried through the apparatus on the supports 3 of the conveyor along its upper reach with the units extending up through the space 93 between the panels 91.

The means 11 for supplying the first web F1 of heat-sealable wrapping material to lie under a unit U as it proceeds to the stated second position at 3*b* comprises a lower roll holder 95 mounted in the frame 21 within the cabinet structure 87. The web F1 is fed upward and forward from a roll 97 in the holder around the entry end of the conveyor 1 to overlie the upper reach 1*a* of the conveyor (see FIGS. 3 and 9–11) thus to underlie units U as they proceed to said second position at 3*b*. The means for supplying the second web F2 of heat-sealable wrapping material to lie on top of a unit U as it proceeds to said position comprises an upper roll holder 99 mounted at the upper rear of a housing 101 extending up from the top of the cabinet structure 87 at the sealing station S, and a guide roller 103 for guiding the web F2 from a roll 105 in the holder 99 to proceed forward on top of units U as they move forward. The housing 101 bridges the panels 91 at the sealing station S and has an opening 105 for passage of units U as they move forward on the upper reach 1*a* of the conveyor 1.

The means 15 for sealing the webs F1 and F2 together comprises upper and lower horizontal sealing bar assemblies 107 and 109 corresponding generally to the horizontal sealing bar assemblies 107 and 109 shown in my aforesaid U.S. application Ser. No. 435,731, these sealing bar assemblies extending transversely of the apparatus at the sealing station S and being vertically movable toward and away from one another in the vertical transverse plane of the housing 101 at the sealing station. The upper assembly 107 comprises a horizontal bar 111 (see FIG. 7) mounted for vertical sliding movement on a pair of vertical guide rods 113 at opposite sides of the apparatus and an anvil 115 carried by the bar at its bottom. The lower assembly 109 comprises a horizontal bar 117 also mounted for vertical sliding movement on the rods 113, and a sealing bar 119 on top of bar 117 having an electrical resistance heater (not shown) and a cutting blade 120 incorporated therein. The length of the sealing bar 119 is somewhat less than the length of a gap 5 in the conveyor 1 (i.e., less than the distance between the chains 37 of conveyor 1) so that this bar 119 may move up and down through a gap 5 as will appear. Means is provided for moving the anvil 115 down and the seal bar 119 up from an open retracted position (wherein the anvil is raised and the seal bar is lowered) into engagement with one another for sealing and severing the film, and then moving the anvil back up and the sealing bar back down to their respective retracted positions. This means comprises an upper crankshaft 121 (in the housing 101) having cranks 123 connected by links 125 to the bar 111 carrying the anvil 115, and a lower crankshaft 127 (at the bottom of frame 21) having cranks 129 connected by links 131 to the bar 117 carrying the sealing bar 119. The upper and lower crankshafts 121 and 127 are intermittently driven through a one-revolution cycle by a chain and sprocket drive mechanism similar to the chain and sprocket mechanism for driving the sealing bar assemblies shown in my aforesaid U.S. application Ser. No. 435,731 including a sprocket 133 (corresponding to sprocket 175 of said application) fixed to a sprocket 135 (corresponding to sprocket 171 of said application). Sprocket 135 is driven via a chain and sprocket drive 137 from the drive shaft 79. Sprocket 133 drives a shaft 139 via a chain and sprocket drive 141. Shaft 139 drives the lower crankshaft 127 via a chain and sprocket drive 143. Shaft 139 also drives a shaft 145 via a chain and sprocket drive 147 and shaft 145 drives the upper crankshaft 121 via a chain and sprocket drive 149, a shaft 151, and a chain and sprocket drive 153.

Figure 7:
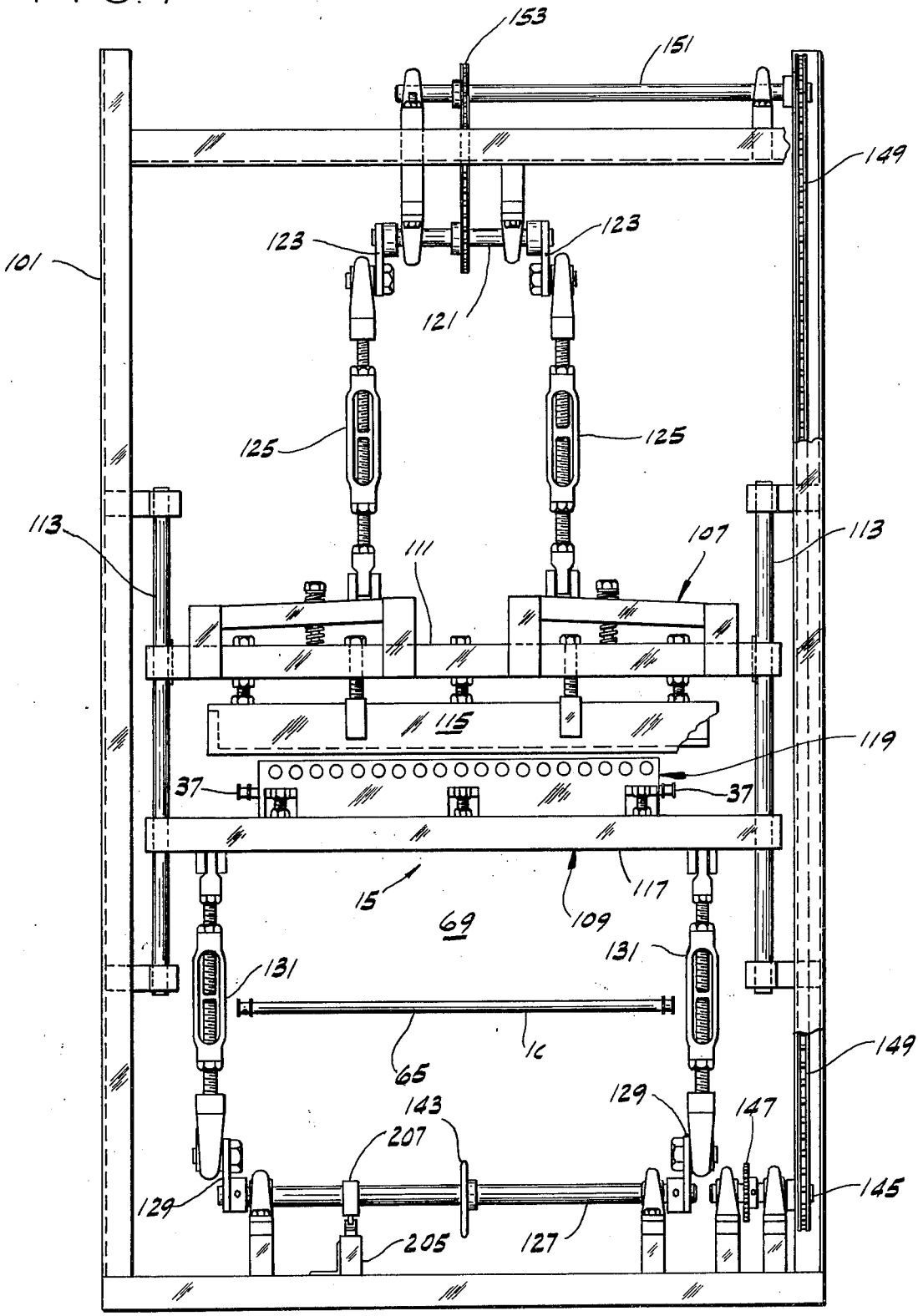
FIG. 7 is an enlarged vertical transverse section on line 7—7 of FIG. 2.
Figure 8:
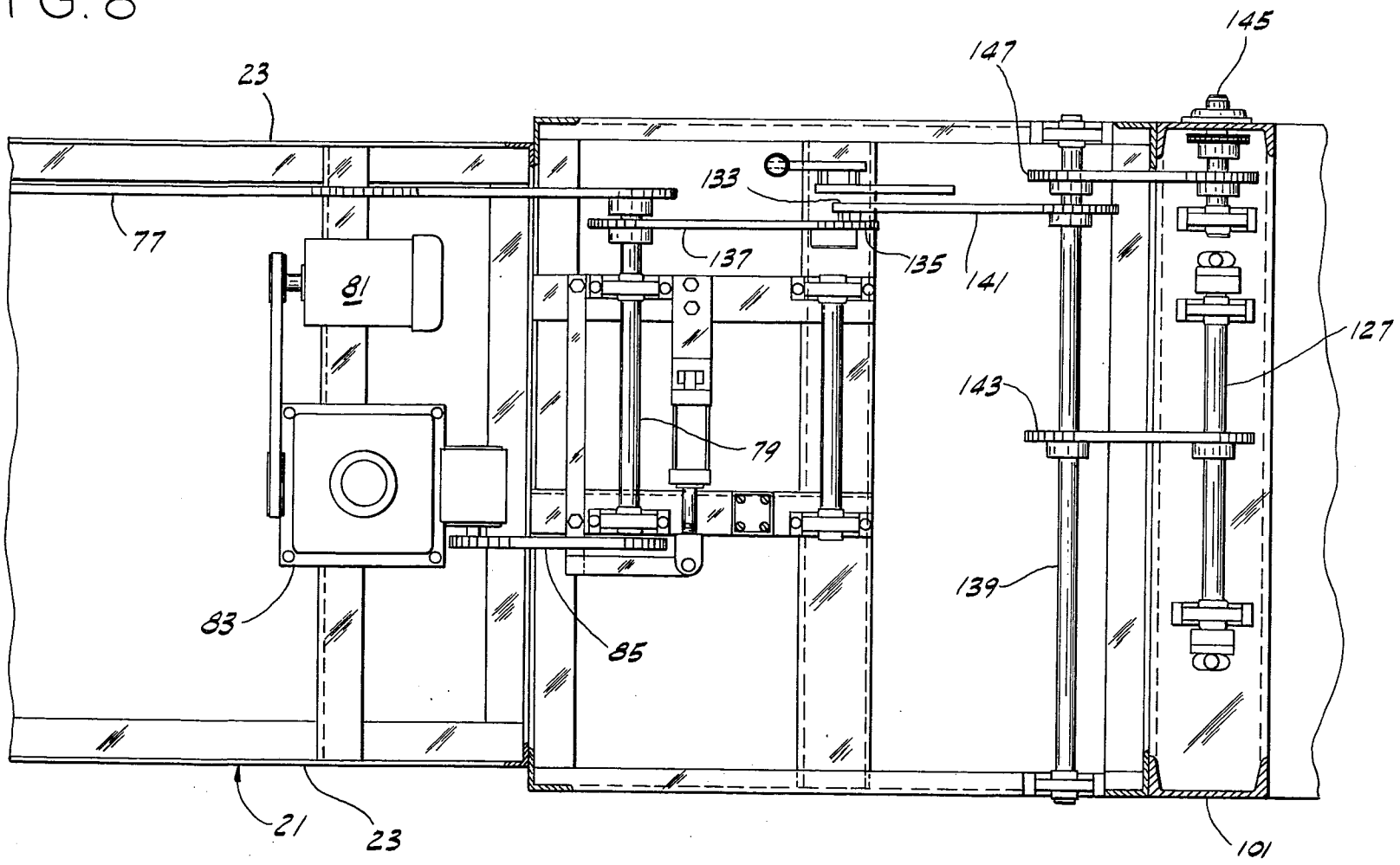
FIG. 8 is an enlarged horizontal section on line 8—8 of FIG. 2.

The sprockets 55 for the return reach 1*b* of the conveyor 1 are located adjacent the sealing station S on its upstream side in respect to the direction of feed of units U and the sprockets 53 are located adjacent the sealing station on its downstream side and slightly above the sprockets 55. Accordingly, the conveyor has a portion 1*c* of its lower reach passing through the sealing station below its upper reach. This portion 1*c* passes over sprockets 53 and sprockets 55, and is inclined downwardly from sprockets 53 to sprockets 55. The lower sealing bar assembly 109 is located above portion 1*c*, this portion passing between the links 131 as shown in FIG. 7.

At 155 is generally indicated means for effecting delivery of a predetermined number of transverse rows of products (e.g., four transverse rows T1 – T4 of cans C) constituting a unit U to the main conveyor 1. This delivery means comprises an infeed conveyor 157, shown as an endless belt conveyor, for feeding cans C in rows in the direction toward the entry end of the main conveyor, the rows being established by means of partition plates 159 (see FIG. 12) extending longitudinally of the infeed conveyor above its upper reach. Cans are placed on the upper reach 157*a* of the infeed belt conveyor 157 standing upright, and move forward with the upper reach of the belt conveyor in the direction toward the entry end of the main conveyor, being channeled into rows extending longitudinally on the upper reach of the belt conveyor by the partition plates. As shown, there are seven such plates for forming the six longitudinal rows L1 – L6. The endless belt 157, at its exit end, is trained around a roller 161 spaced rearward of the entry end of the main conveyor 1, and a plate 163 constituting a table for receiving cans from the belt 157 is mounted at the top of the frame 21 filling in the space between the exit end of the upper reach of the belt 157 and the entry end of the upper reach 1*a* of the main conveyor 1. The belt 157 is continuously driven by a suitable drive (not shown) to tend continuously to feed cans forward toward the table, and is adapted to slide under the cans when the latter are arrested, as will appear. The upper reach of the belt 157, the table 153, and the upper reach 1*a* of the main conveyor 1 are all substantially flush with one another.

The delivery means 155 further comprises means indicated generally at 165 for separating a predetermined number of transverse rows of products (e.g., four transverse rows T1 – T4 of six cans each) from the forward (downstream) end of the series of rows of cans fed forward by the infeed conveyor 157 to form the units U, and for pushing each unit U forward over the table 163 onto the upper reach 1*a* of the main conveyor 1. This separation means, as shown in FIGS. 1A, 3, 5 and 6, is in the form of a reel comprising left and right side heads 167 and 169 rotatable on a shaft 171 supported at the upper end of posts 173 extending up from the top of the base cabinet structure 87 at opposite sides thereof, the shaft 171 extending horizontally transversely across the apparatus above the table 163. The heads 167 and 169 are square. Four shafts each designated 175 extend between the heads 167 and 169, one at each of their four corners, each shaft being journalled for rotation relative to the heads in bearings 177 in the heads. The shafts lie on a circle centered in the shaft, being spaced at 90° around this circle. Extending down from each shaft is a plate 179 adapted to act as a stop means and a pusher means for the cans as will appear. Each of the plates has its bottom edge scalloped to provide, in effect, a series of fingers 181 spaced at intervals across the lower end of the plate adapted to enter the spaces between cans C in the series of cans fed forward by the infeed conveyor 157. The plates 179 extend vertically downward from the shafts 175 and are maintained in their downwardly extending vertical position on rotation of the reel via chain and sprocket mechanism (see FIG. 5) on the outside of the left side head 167 of the reel. This mechanism comprises a chain 183 trained around sprockets 185 on the ends of the shafts 175 and idler sprockets 187 on the head, and a chain and sprocket drive 189 between the center shaft 171 and one of the shafts 175.

Means is provided for intermittently rotating the reel 165 in 90° steps (in counterclockwise direction as viewed in FIG. 3) successively to bring a plate 179 from a first position P1 to second, third and fourth positions P2 – P4 (see FIG. 3), and then back to position P1 to repeat the cycle. This means comprises a clutch 191 having its input driven by the shaft 63 for the sprockets 57 of the chains 37 of the main conveyor 1, and having its output connected to drive the reel 165 via a chain and sprocket drive 193, including a sprocket 195 on the right side head 169 of the reel. The clutch may be an air-operated clutch, for example, and is intermittently actuated to index the reel through 90° of rotation. Means is provided for stopping the reel at the termination of each 90° indexing operation and holding it in its indexed position comprising a ratchet 197 on the reel on the outside of the right side head 169 having teeth 199 spaced at 90° intervals and a detent or pawl 201 engageable with the ratchet controlled by an air cylinder 203.

The arrangement is such that, with the reel 165 at rest in any one of its four dwell positions as determined by engagement of one of the four ratchet teeth 199 with the detent 201, the plate 179 (at the lower forward corner of the reel) at P2 is in a forward lowered position wherein it is engageable by the forwardmost transverse row of cans C to arrest the forward movement of the entire series of rows of cans by the infeed conveyor 157. The plate at P1 (at the lower rearward corner of the reel) is in a rearward slightly raised position wherein its lower edge is slightly above the level of the top of the cans on the infeed conveyor and in position to move downward behind the fourth transverse row T4 of cans back from the forward-most row on the next indexing operation of the reel. The plate at P4 is above the plate at P1 ready on the next indexing operation to move down to the P1 position, and the plate at P3 is above P2 ready to move rearward to the P4 position.

Referring to FIG. 7, there is indicated a switch 205 operable by a cam 207 on the crankshaft 127. This switch controls an air valve for actuating the clutch 191 and for operating the air cylinder 203, the arrangement being such as to actuate the switch in properly timed relation to the operation of the conveyor 1 so as to start the reel 165 through an indexing operation when the anvil 115 and sealing bar 119 open and the conveyor 1 starts through a cycle.

Figure 9:
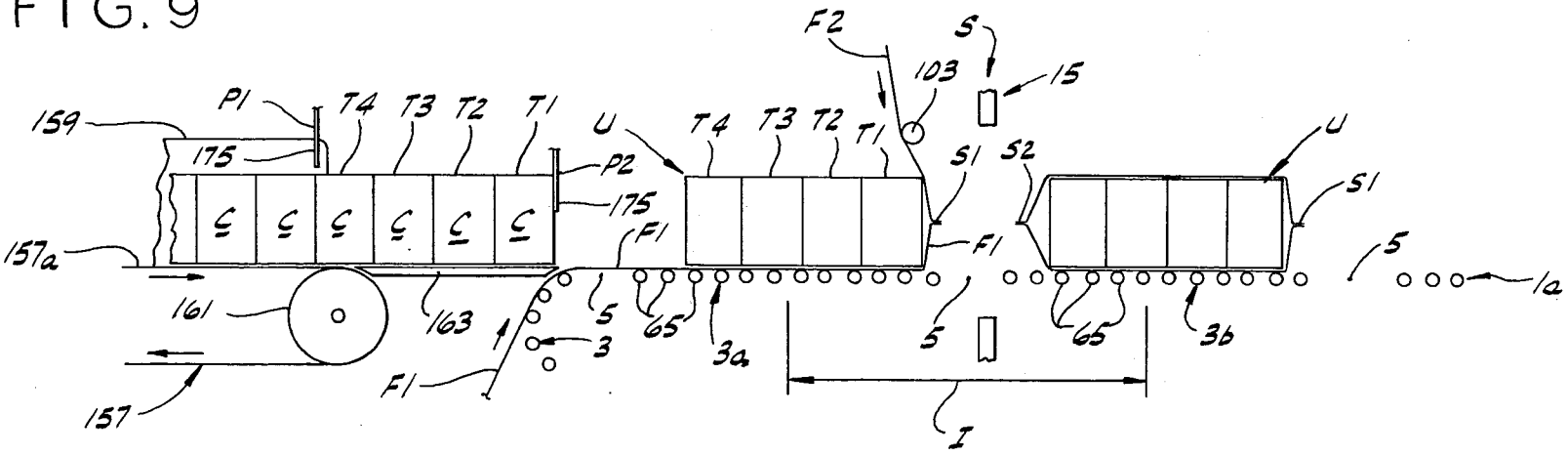
FIG. 9 is a diagrammatic view showing conditions at the start of a cycle of operation of the apparatus.

Operation is as follows:

Immediately prior to the start of each cycle of operation of the apparatus, the main conveyor 1 will be at rest, dwelling in a position wherein one of the gaps 5 in its upper reach 1*a* is at the sealing station S, with one of the supports 3*a* of the conveyor in its upper reach at the stated first position immediately upstream from (rearward of) the sealing station, and with the support 3*b* leading 3*a* at the stated second position immediately downstream from (forward of) the sealing station (see FIG. 9). There will be a completed sleeve-wrapped unit U on the support 3*b* and on each of the supports 3 in the upper reach 1*a* of conveyor 1 downstream from (forward of) the support 3*b* all the way through the shrink tunnel 29. There will be a unit U, consisting of four transverse rows T1 – T4 of six cans each, on the support at 3*a* ready to be sleeve-wrapped. There will be an infeed series of transverse rows of cans (six cans in each transverse row) on the upper reach 157*a* of the infeed belt conveyor 157 and on the table 163, with the forwardmost row (T1) in this series engaging the plate 175 at P2 and thereby holding the entire series stationary. The upper reach 157*a* of the belt conveyor 157, which as previously noted is continuously driven, simply slips by underneath the cans on this reach. The web F2 extends down from the upper roll 105 around the guide roller 103 in front of the unit U which is at the 3*a* position and the web F1 extends up from roll 97 around the rearward (entry) end of the main conveyor 1, forward over the upper reach 1*a* of the conveyor 1, and up in front of the unit U at the 3*a* position, the ends of the two webs meeting in front of this unit U and being heat-sealed together by a seal S1 (see FIG. 9). Anvil 115 is raised, and seal bar 119 is lowered below the upper reach 1*a* of the conveyor.

Figure 10:
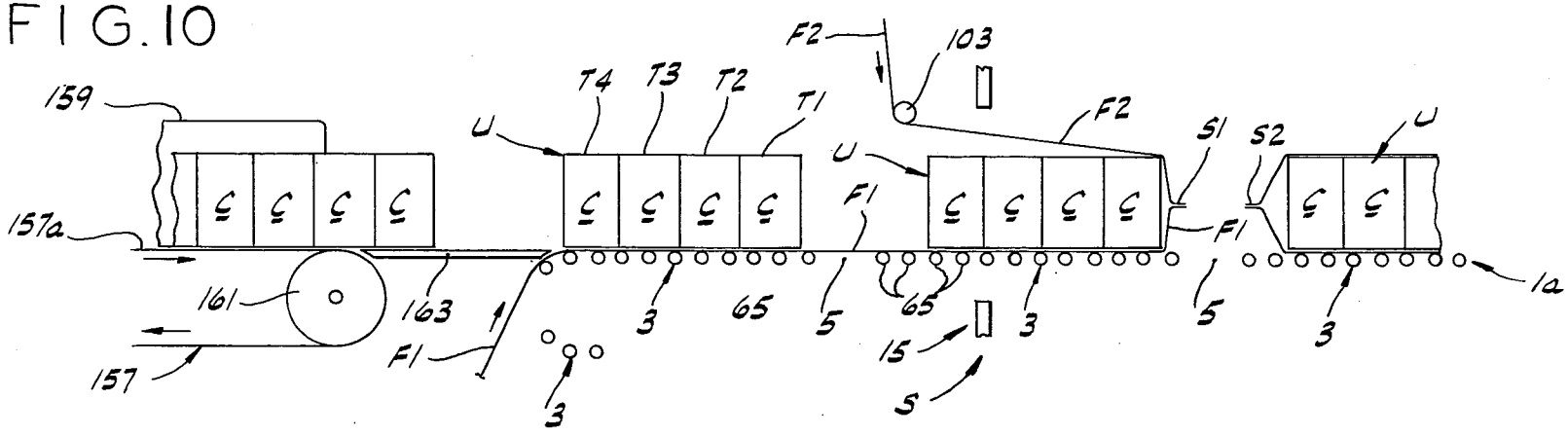
FIG. 10 is a diagrammatic view showing units moving forward in the course of a cycle.
Figure 12:
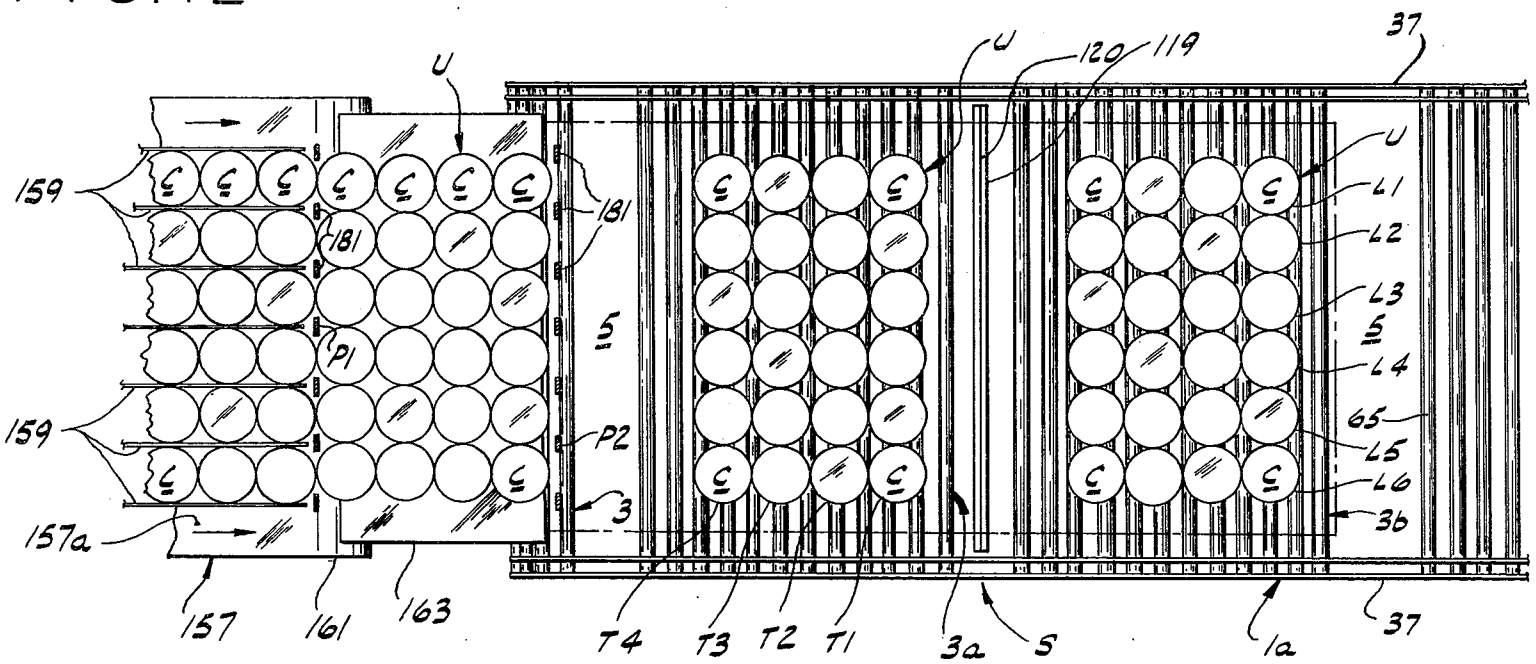
FIG. 12 is a plan of FIG. 11.
Figure 11:
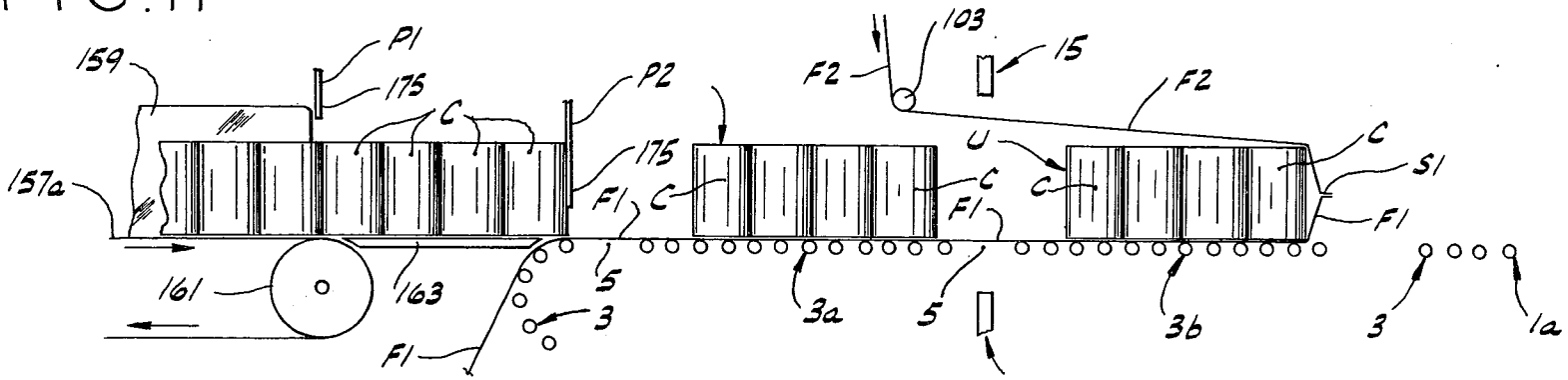
FIG. 11 is a diagrammatic view showing the units as they complete their forward movement and before the sealing means is actuated to seal the webs.

A cycle of operation may be regarded as starting when the drive mechanism 9 for the main conveyor 1 starts the forward movement of the upper reach 1*a* of the conveyor 1 from the position such as shown in FIG. 9. As the upper reach 1*a* of the conveyor 1 moves forward, it transports forward all the enwrapped units on the support at 3*b* and the supports 3 downstream from 3*b,* and simultaneously transports forward the unit U on the support 3*a,* moving it through the sealing station S as shown in FIG. 10 to the 3*b* position as shown in FIG. 11. As the unit U moves forward from the 3*a* to the 3*b* position (from the FIG. 9 through the FIG. 10 to the FIG. 11 position) it engages the reach of film which extends in front (on the downstream side) of the unit U, and which is constituted by an upwardly extending portion of the film F1 and a downwardly extending portion of the film F2 joined at a heat seal such as indicated at S1 as a result of the previous sealing operation.

The unit U, moving forward to position 3*b*, pushes the film forward as shown in FIG. 10, as a result of which the upper web F2 becomes draped over the unit, the lower web F1 already being draped under the unit. The main conveyor stops when the unit U reaches the 3*b* position (as shown in FIG. 11), and then the drive mechanism 135, 137 etc. for the seal bar assemblies 107 and 109 acts to close the anvil 115 and sealing bar 119 on the webs behind the unit U at 3*b* as shown in FIG. 3 to effect heat-sealing together of the two webs F1 and F2 and severing of the webs through the seal (as in my aforesaid U.S. application Ser. No. 435,731) so as to provide a trailing seal S2 for the film draped around the unit at 3*b* and a seal S1 constituting the leading seal for the next operation. The sealing bar 119 moves up through the gap 5 in the upper reach 1*a* of the conveyor 1 at the sealing station, and the webs are sealed generally at midheight of the unit U. The anvil 115 and seal bar 119 then open, and, after a brief interval, the apparatus operates through another cycle. On opening, the bar 119 descends below the upper reach 1*a* of the conveyor, enabling the conveyor to index.

When conveyor 1 is started in operation through a cycle, the clutch 191 is engaged for indexing the reel through a cycle (i.e., through a 90° interval of rotation in counterclockwise direction as viewed in FIG. 3) and cylinder 203 is actuated to withdraw the detent 201 from the ratchet 197 to permit the reel 165 to rotate. Cylinder 203 is deactuated after the reel has started to rotate to return the detent into engagement with the ratchet to arrest the reel after it has indexed through the 90° interval. As the reel rotates counterclockwise as viewed in FIG. 3 through its 90° cycle, the plate 175 which was at the P2 position moves forward and upwardly away from in front of the series of cans C and the plate 175 which was at the P1 position moves down into the series of cans behind the fourth transverse row T4 of cans and also moves forward, thereby pushing forward the first four transverse rows T1 – T4 of cans (constituting a unit U which may be referred to as the infeed unit U). The plate 175 which moves forward from the P1 to the P2 position pushes this infeed unit U forward over the table 163 onto a support 3 of the main conveyor 1 as this support 3 comes up around the sprockets 39 at the entry end of the conveyor. This support moves forward to the 3*a* position, thus transporting the infeed unit U to the 3*a* position in readiness to be sleeve-wrapped on the next cycle of operation. The stated plate, having pushed the infeed unit U onto conveyor 1, stops in the P2 position to arrest the forward movement of the supply series of cans by the infeed conveyor 1. The next plate in the series stops in position P1, above the cans, so as to enable the cans to be fed forward by the infeed conveyor.

The 24 cans separated from the infeed series to constitute a unit U are pushed forward onto the main conveyor 1 in orderly array and reach the position 3*a* without disorientation, ready to be sleeve-wrapped on the next cycle of operation of the apparatus. Then, they are carried on the support on which they rest through the sealing station over to position 3*b*, being wrapped without disorientation in view of their being supported throughout the wrapping operation on the support 3 of the conveyor which comes from 3*a* to 3*b*.

For handling six-packs, the plates 179 may be replaced by pins.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Sleeve-wrapping apparatus for wrapping units each consisting of a number of rows of products comprising an endless main conveyor having a generally horizontal upper reach for transporting units forward along a generally horizontal path and a return reach below the upper reach, said conveyor comprising a series of supports each adapted to hold a unit spaced at intervals along and throughout the length of the conveyor with gaps between the supports, means for intermittently indexing the conveyor forward through a distance equal to one of said intervals with a dwell between successive cycles of operation successively to bring a gap in the conveyor to a sealing station located along said path, whereby, during each dwell of the conveyor between cycles, there is a gap at the sealing station, a support at a first position upstream from the sealing station and a support at a second position downstream from the sealing station, the support at the first position being at the upstream end of said upper reach and adapted to receive and hold a unit to be wrapped and to transport it, on indexing of the conveyor, through the sealing station to the second position, means for supplying a first web of heat-sealable wrapping material to extend over the support at the first position and under a unit on said first support as said first support and said unit proceed to the second position, means for supplying a second web of heat-sealable wrapping material to lie on top of said unit as it proceeds to the second position, means for sealing the two webs together at said sealing station and severing the webs through the seal to form a trailing seal for the webs draped around the unit at the second position and a leading seal for the unit at the first position, said sealing means being operable through the gap in the endless conveyor at the sealing station during each dwell of the conveyor, means for feeding forward a series of rows of products in the direction toward said upstream end of the upper reach of the main conveyor, and means operable during each dwell of the main conveyor for arresting the forward feed of said series of rows upstream from the upstream end of the upper reach of the main conveyor and operable upon indexing of the main conveyor to release the rows for forward feed thereof and to push forward a predetermined number of rows of products forming a unit onto a support of the main conveyor as it comes around and forward to its said first position, whereby, on each indexing of the main conveyor, a unit is moved from said first position through the sealing station to the second position for being wrapped, and another unit for the next cycle of operation is delivered onto the support of the main conveyor which comes to the first position.

2. Apparatus as set forth in claim 1 wherein said means for feeding forward the series of rows of products comprises an endless delivery conveyor having an upper generally horizontal reach generally flush with the upper reach of the main conveyor and means for continuously driving said delivery conveyor for feeding said series of rows of products forward, said delivery conveyor slipping underneath said products when the forward feed of said series is arrested, and said arresting and pushing means comprises an endless series of members spaced at intervals corresponding to a predetermined number of rows of products located above the downstream end of the upper reach of the delivery conveyor and movable in steps to move one of said members from a forward and down position wherein it arrests the forward feed of said series of rows, up and out of the way of the rows, and to move the next member of the series from a rearward raised position down behind a row and forward to separate a unit and push it forward onto the support at said first position, and means operable to move said series of members through one step in response to indexing the main conveyor forward.

* * * * *